US005406020A

United States Patent [19]

Imaizumi

[11] Patent Number: 5,406,020

[45] Date of Patent: Apr. 11, 1995

[54] AUTOMATIC ACCOMPANIMENT DEVICE WITH VARIABLE MUSIC INTRODUCTION PATTERN PERFORMANCE LENGTH

[75] Inventor: Tsutomu Imaizumi, Hamamatsu, Japan

[73] Assignee: Yamaha Corporation, Hamamatsu, Japan

[21] Appl. No.: 38,128

[22] Filed: Mar. 26, 1993

[30] Foreign Application Priority Data

Mar. 31, 1992 [JP] Japan ..... 4-077871

[51] Int. Cl.[6] ..... G10H 1/36; G10H 1/38; G10H 1/42

[52] U.S. Cl. ..... 84/610; 84/634; 84/DIG. 12; 84/DIG. 22

[58] Field of Search ..... 84/609-614, 84/634-638, DIG. 12, DIG. 22

[56] References Cited

U.S. PATENT DOCUMENTS

| | | | |
|---|---|---|---|
| 4,357,854 | 11/1982 | Hirano | 84/DIG. 12 |
| 4,643,068 | 2/1987 | Okuda et al. | 84/DIG. 12 |
| 5,164,531 | 11/1992 | Imaizumi et al. | 84/634 |
| 5,208,416 | 5/1993 | Hayakawa et al. | 84/634 |
| 5,221,801 | 6/1993 | Bruti | 84/612 |

FOREIGN PATENT DOCUMENTS 61-292693 12/1986 Japan .

*Primary Examiner*—Stanley J. Witkowski
*Attorney, Agent, or Firm*—Spensley Horn Jubas & Lubitz

[57] ABSTRACT

An automatic accompaniment device equipped with a CPU that controls, via a bus, a ROM that stores a plurality of rhythm patterns including introduction patterns, fill-in patterns and normal patterns. The device also includes a sound source circuit that generates musical sounds based on rhythm pattern data that is supplied after being selected by switches on an operation panel. In operation, the performer selects an introduction pattern to begin the automatic accompaniment. If the performer desires a shorter introduction, the performer activates a switch on the operation panel that causes a fill-in pattern to begin at a musically natural point in the introduction pattern. The fill-in pattern is shorter than the introduction pattern and provides a musically natural and smooth transition to the normal pattern. Thus, it is possible to end an introduction pattern at an optional point without imparting a musically unnatural quality to the automatic accompaniment.

14 Claims, 13 Drawing Sheets

AUTOMATIC ACCOMPANIMENT DEVICE WITH VARIABLE MUSIC INTRODUCTION PATTERN PERFORMANCE LENGTH

BACKGROUND OF THE INVENTION

1. Field of the Invention

The present invention relates to an automatic accompaniment device in which the musical introduction can be ended at an optional length.

2. Explanation of the Related Art

A variety of automatic accompaniment devices which automatically generate an accompaniment have been developed previously. In automatic accompaniment devices of this type, prescribed accompaniment patterns, i.e., rhythm patterns, base patterns and chord patterns (chord backing patterns) are stored for the rhythm musical sounds, base sound and chords, and each musical sound is generated according to these patterns. In this case, for each musical sound, the data designating each sounding event (hereafter referred to as "note event data") is stored with each timing data which designates the timing at which each event is to be generated. During an automatic accompaniment, the stored timing data and the current timing in the performance are compared and, when found to be identical, the note event data is read out, thus controlling the sounding of each musical sound. The stored accompaniment patterns frequently are comprised of a plurality of bars, such as, for example, two bars or four bars.

When considering the accompaniment patterns starting from the beginning of the performance of a tune, it is possible to sequentially divide the accompaniment patterns into three main parts —the introduction pattern, the normal pattern and the ending pattern. Further, performances according to fill-in patterns are sometimes inserted during one of the above patterns. The fill-in performance used in such a case is initiated through the operation of a specified switch by the performer. Ordinarily, fill-in patterns of one bar are common.

In conventional devices, an introduction performance according to an introduction pattern is initiated by a designation to begin an accompaniment performance. When the introduction pattern is completed, the program shifts to a normal pattern, this normal pattern is repeatedly performed and, in this manner, the performance is carried out. The number of bars (length) in the introduction is set according to the styles of each accompaniment.

However, even in the case where the styles of the accompaniment are the same, it is not uncommon that a performer, in line with a personal preference, may desire to change the length of the introduction. However, in conventional devices, because the length of the introduction was fixed according to the styles of the accompaniment, it was not possible to break off the introduction at a midway point in accordance with the preference of the performer. Thus, conventional devices were problematic in that they did not meet the demands of the performer.

SUMMARY OF THE INVENTION

An object of the present invention is to provide an automatic accompaniment device which terminates an introduction performance at an optional point without imparting a musically unnatural quality to the performance.

According to the present invention, we utilize an automatic accompaniment device which generates accompaniment sound according to an accompaniment pattern. The automatic accompaniment device comprises;

a storing means for storing each of a first accompaniment pattern consisting of a plurality of bars, a second pattern consisting of an optional number of bars and a third accompaniment pattern consisting of fewer bars than said first accompaniment pattern;

a first designating means which designates the read out of said first accompaniment pattern read out from said storing means;

a second designating means which designates the read out of said third accompaniment pattern read out from said storing means; and a read out means which reads out said first accompaniment pattern in response to a read out designation from said first designating means, and thereafter repeatedly reads out said second accompaniment pattern, and which reads out said third accompaniment pattern in place of said first accompaniment pattern when a read out designation is made by second designating means during the read out of said first accompaniment pattern, and thereafter repeatedly reads out said second accompaniment pattern.

Preferably, said first accompaniment pattern is an introduction pattern performed at the beginning of a performance, said second accompaniment pattern is a normal pattern performed repeatedly, and said third accompaniment pattern is a fill-in pattern inserted during the performance of an introduction pattern.

According to the present invention, the shift to the normal pattern is accomplished without imparting an musically unnatural quality to the performance due to the abrupt termination of the introduction performance, because the accompaniment pattern shifts first to a fill-in pattern before shifting to a normal pattern.

BRIEF DESCRIPTION OF THE DRAWINGS

The foregoing brief description, as well as further objects features, and advantages of the invention will be understood more completely from the following detailed of the presently preferred, but nonetheless illustrative, embodiment of the invention, with reference being had to the drawing, in which;

FIG. 14 (*b*) is a flow chart showing the fill-in n readout processing (2) in the automatic accompaniment device of the present invention.

PREFERRED EMBODIMENTS OF THE PRESENT INVENTION

An explanation of the preferred embodiments of the present invention will be explained below with reference to the Figures.

Figure 1:
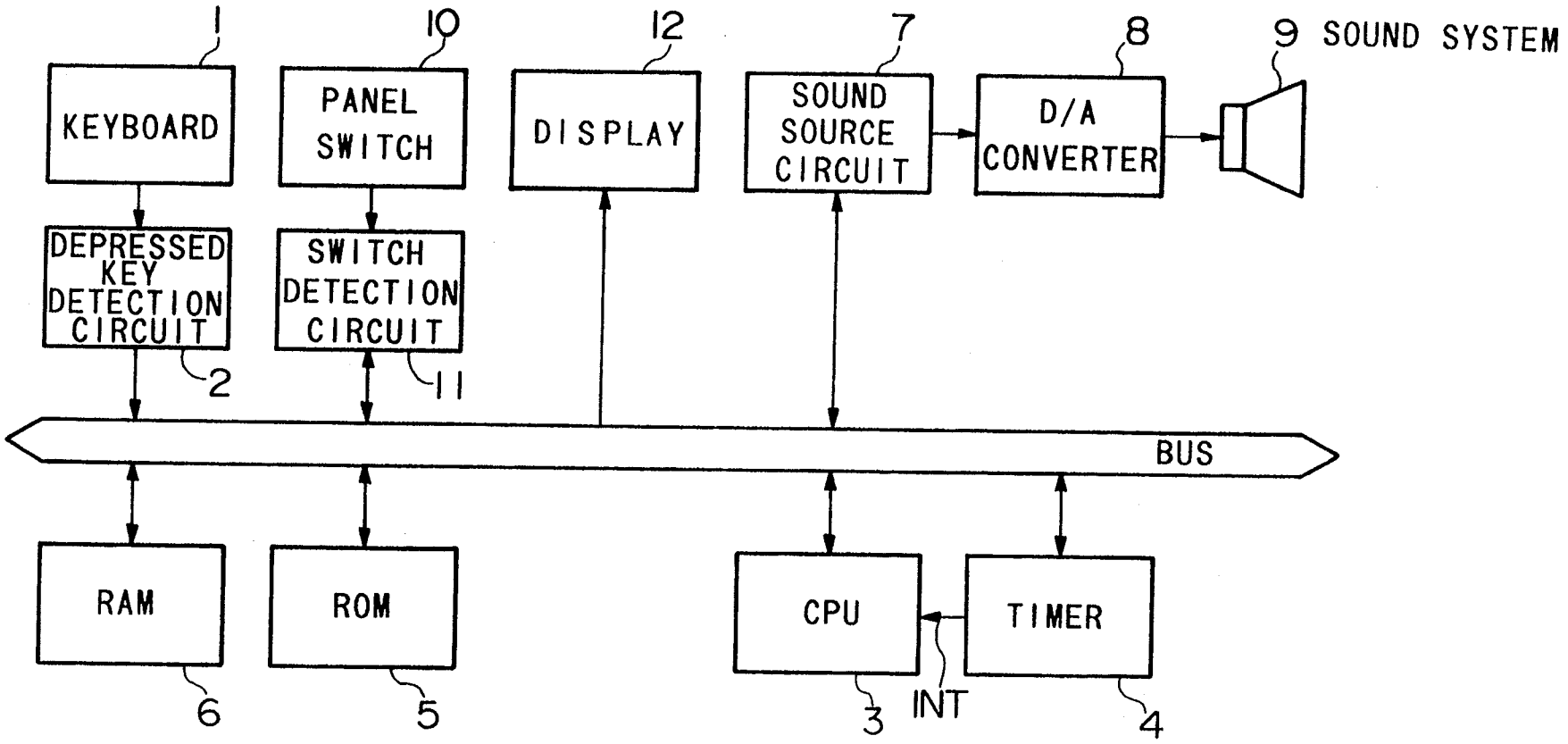
FIG. 1 is a block diagram showing the electronic structure of the automatic accompaniment device according to the present invention.

A: Structure of the Embodiment FIG. 1 is a block diagram showing the electronic structure of an embodiment of the present invention. In this figure, keyboard 1 is comprised of a plurality of keys. The depressed or released state of each key is detected by depressed key detection circuit 2. The detected signal is supplied to the CPU (Central Processing Unit) 3 via the bus. Timer 4 supplies an interrupt signal INT to CPU 3. CPU 3 executes a specified timer interrupter processing (explained below) when supplied with an interrupt signal INT. Further, timer 4 outputs the interrupt signal INT in accordance with the tempo of the tune.

ROM (Read Only Memory) 5 stores the program used in CPU 3 and the rhythm pattern data used in the rhythm performance are stored in this ROM 5. A variety of registers, which will be explained below, are set in the RAM (Random Access Memory) 6. Sound source circuit 7 generates a musical sound signal based on the control from CPU 3. Following conversion by D/A (Digital to Analog) converter 8 to an analog signal, the musical sound signal generated by the sound source circuit 7 is sounded by a sound system 9 comprising amplifiers, speakers and the like.

Panel switch 10 is comprised of a variety of switches. The ON/OFF status of each switch is detected by switch detection circuit 11, and the detected signal is supplied to CPU 3 via the bus. Display 12 carries out the display of a variety of designations based on the control from CPU 3.

A-1: Detailed Structure of ROM 5

The structure of the rhythm pattern data stored in ROM 5 will now be explained with reference being made to FIG. 2.

Figure 2:
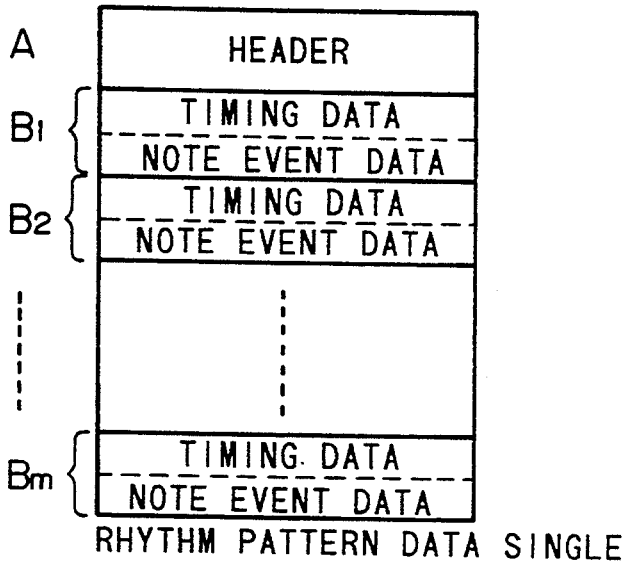
FIG. 2 is a memory map showing the memory state of a single rhythm pattern data in the ROM 5 shown in FIG. 1.

The block A shown in FIG. 2 is a header. Basic data such as the beat data, showing the number of beats in the rhythm pattern data, and bar data, showing the number of bars, is written in block A.

Further block B1 designates the contents of a single event data (data designating the generation of a single sound), and consists of timing data, which designates the sounding timing of the bars, and note event data, which designates the contents of the rhythm notes to be sounded.

For this embodiment, because the length of a quarter note (period) corresponds to the length of 24 clock units, the length of a single bar is, for example, 96 clock units for 4 beats, and 72 clock units for 3 beats. The value of the clock number corresponding to the sounding timing of the bars is written in the timing data. For example, in the case of 4 beats, a clock number value corresponding to 0 to 95 is written in timing data, while for the case of 3 beats, a clock number value corresponding to 0 to 71 is written in timing data. The note event data comprises the note number, which designates the type of rhythm sound to be sounded (percussion, etc.), and the velocity, which designates the strength of the sound. As many blocks B2, B3, . . . Bm are provided as there are m number of events (where m is an integer). Further, for patterns comprising a plurality of bars, the bar data (not shown in the Figures) is stored for each event data of a single bar.

This rhythm pattern data is identical for each of the introduction, fill-in and normal patterns. In this embodiment, two types of introduction patterns, four types of fill-in patterns and two types of normal patterns are set. In order to distinguish between these, the two types of introduction patterns will be referred to as "introduction 1 pattern" and "introduction 2 pattern"; the four types of fill-in patterns will be referred to as "fill:in 1 pattern", "fill-in 2 pattern", "fill-in 3 pattern" and "fill-in 4 pattern"; and the two types of normal patterns will be referred to as "verse pattern" and "chorus pattern ".

Each of the fill-in patterns referred to here has a fewer number of bars than each-of the introduction patterns. For example, each fill-in pattern is a pattern of a single bar portion and each introduction pattern is a pattern of an eight bar portion. Further, each normal pattern is a pattern of an optional length of from one to a plurality of bar portions.

A-2: Structure of Panel Switch 10

Figure 3:
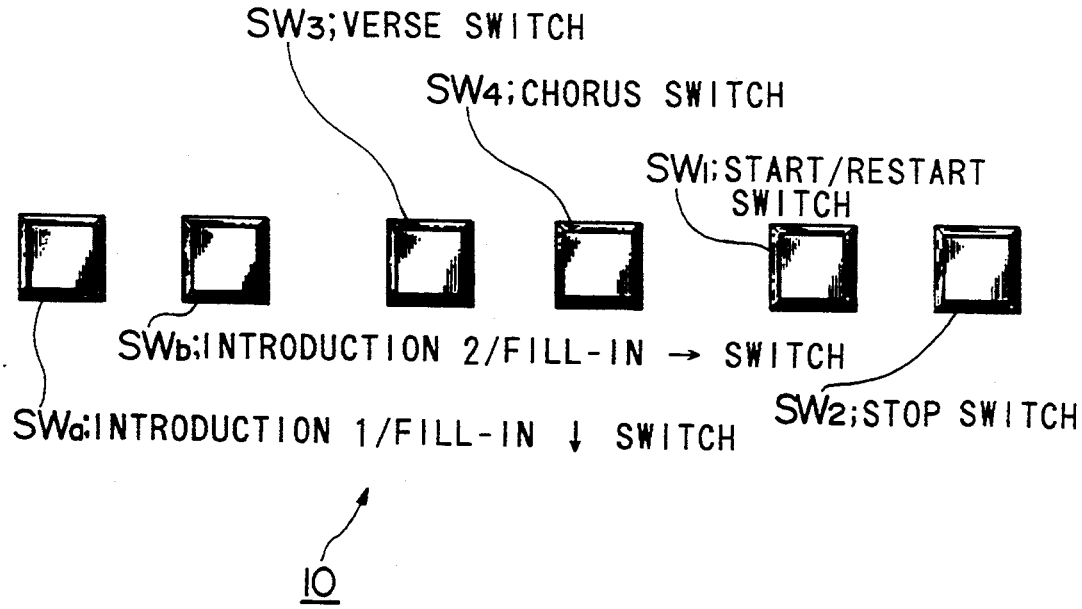
FIG. 3 is a front view showing an external view of the panel switch 10 shown in Fig.

Next, the detailed structure of each of the switches in panel switch 10 will be explained with reference being made to FIG. 3.

A-2-1: Start/Restart Switch $SW_1$

Start/Restart Switch $SW_1$ is a push-on switch for designating the start of a rhythm performance at a time when the rhythm performance has been interrupted. By pushing the start/restart switch, a rhythm performance according to the selected normal pattern is initiated.

Further, during a rhythm performance, the program can be shifted to the beginning of a normal pattern by pushing the start/restart switch $SW_1$, thus restarting the normal pattern. For example, if the program is at some point in the introduction pattern when the start/restart switch $SW_1$ is pushed, then the program will shift immediately to-the beginning of the selected normal pattern. If the sequence is in a fill-in pattern when the start/restart switch $SW_1$ is pushed, then the sequence will shift immediately to the beginning of the selected normal pattern.

This restart function makes it possible to realize rhythms having a changing beat.

A-2-2: Stop Switch $SW_2$

The stop switch $SW_2$ is a push-on switch for designating a rhythm interruption during a rhythm performance. Naturally, the rhythm interruption designation is disregarded should this button be pushed during a rhythm interruption.

A-2-3: Verse Switch $SW_3$ and Chorus Switch $SW_4$

The verse switch $SW_3$ and the chorus switch $SW_4$ are switches for selecting one of either of the normal patterns.

For example, when the verse switch $SW_3$ is pushed during an interruption in a rhythm performance, then, by pushing the start/restart switch $SW_1$, a verse pattern rhythm performance is initialized.

Further, when the verse switch $SW_3$ is pushed during a chorus pattern rhythm performance, then the rhythm performance shifts to a verse pattern from that point on.

When the verse switch $SW_3$ is pushed during an introduction pattern or a fill-in pattern, then a verse pattern (verse reservation) is set as the normal pattern to be shifted to at the end of the pattern being performed.

In the same manner, if the chorus switch $SW_4$ is pushed during an interruption of a rhythm performance, then, by pushing the start/restart switch $SW_1$, a chorus pattern rhythm performance is initiated.

Further, if the chorus switch $SW_4$ is pushed during a verse pattern rhythm performance, then the rhythm performance shifts to the chorus pattern from that point on.

When the chorus switch $SW_3$ is pushed during an introduction pattern or a fill-in pattern, then a chorus pattern is set as the normal pattern to be shifted to atthe completion of the patterns (chorus reservation).

Because, the pattern to be shifted to can be reserved, it is possible to provide for a varied combination of patterns when shifting from the introduction or fill-in patterns to a normal performance, making possible a rhythm performance which is complicated and rich in variation.

A-2-4: Introduction 1/Fill-in ↓ Switch $SW_a$

An introduction according to the introduction 1 pattern is initiated by pushing the introduction 1/fill-in ↓ switch $SW_a$ during an interruption of a rhythm performance. When this introduction 1 pattern ends, the program shifts to the verse pattern.

During a rhythm performance, the aforesaid switch, if pushed, functions as a fill-in switch. For example, if the program is in the verse pattern when this switch is pushed, then the program shifts to the fill-in 1 pattern and, when this fill-in 1 pattern ends, the program again returns to the verse pattern. Further, if the program is in the chorus pattern when this switch is pushed, then the program shifts to the fill-in 2 pattern and, when this fill-in 2 pattern ends, the program again returns to the chorus pattern. In other words, the symbol "↓" signifies the return to the original normal pattern after a fill-in.

By pushing the aforesaid switch during an introduction, the program shifts from an introduction pattern to a fill-in pattern and, after the fill-in pattern ends, the program shifts to a normal pattern. The fill-in pattern inserted at this time is determined by the type of normal pattern to be performed next. For example, if the program shifts to the verse pattern at the end of a fill-in, then the fill-in 1 pattern is inserted. If the program shifts to the chorus pattern at the end of a fill-in, then the fill-in 2 pattern is inserted.

Further, because the fill-in pattern is shorter pattern than the introduction pattern, if, for example, the introduction 1/fill-in ↓ switch $SW_a$ is pushed at the fourth bar of above mentioned eight bar introduction pattern, then the program shifts to the normal pattern after performing a fill-in pattern through the end of the fourth bar. By this means, it is possible to end the introduction performance after four bars.

A-2-5: Introduction 2/Fill-in →Switch $SW_b$

An introduction according to the introduction 2 pattern is initiated by pushing the introduction 2/fill-in switch →$SW_b$ during an interruption of a rhythm performance. When this introduction 2 pattern ends, the program shifts to the chorus pattern.

During a rhythm performance, the aforesaid switch, if pushed, functions as a fill-in switch. For example, if the program is in the verse pattern when this switch is pushed, then the program shifts to the fill-in 3 pattern and, when this fill-in 3 pattern ends, the program again returns to the chorus pattern. Further, if the program is in the chorus pattern when this switch is pushed, then the program shift to the fill-in 4 pattern and, when this fill-in 4 pattern ends, the program shifts to the verse pattern. In other words, the symbol "→" signifies the shift to a pattern different from the original normal pattern after a fill-in.

When the aforesaid switch is pushed during an introduction or fill-in, then the introduction 2/fill-in → switch $SW_b$ functions the same as the introduction 1/fill-in ↓ switch $SW_a$.

B: Operation of the Embodiment

Next, an explanation of the operation of the embodiment based on the above described structure will be explained with reference being made to FIGS. 4 through 14. Each of the routines executed in CPU 3 will be explained separately.

B-1: Operation of Main Routine

Figure 4:
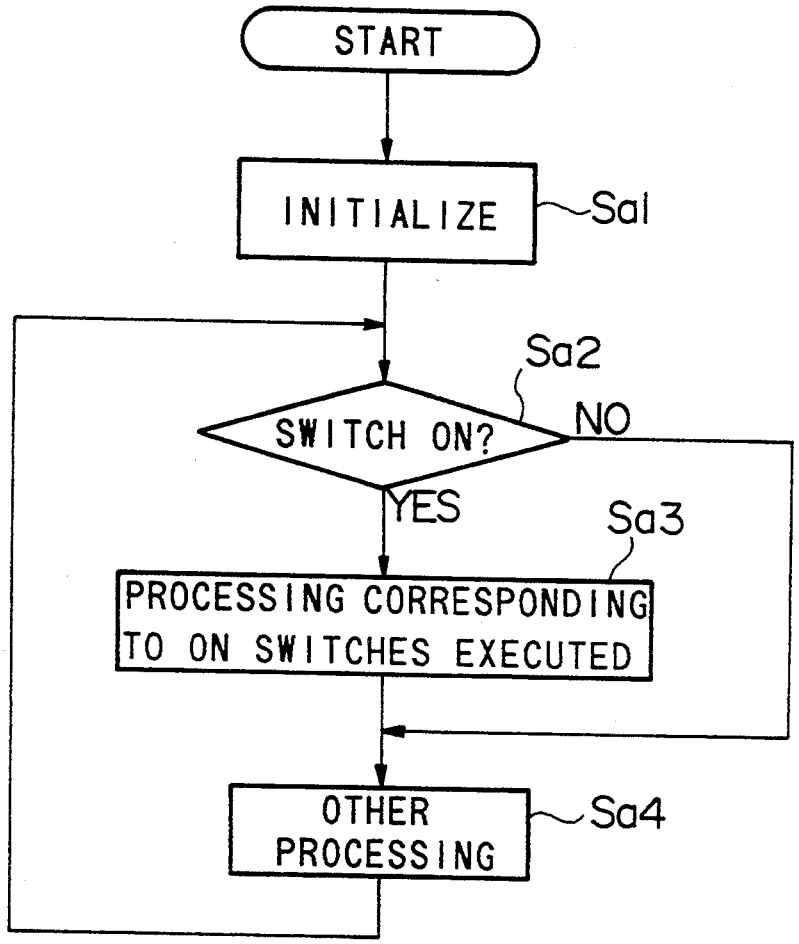
FIG. 4 is flow chart showing the operation of the main routine in the automatic accompaniment device of the present invention.

The main routine shown in FIG. 4 is activated by the supply of electricity to this device.

First, in step Sa1, such initialization processing as zero setting each of the registers in RAM 6, writing the initial set value in each flag, etc. are carried out. For example, if the value of the flag VERSE which shows the type of designated normal pattern is set to be [1] (a flag-VERSE value is [1] designates the verse pattern, and a flag VERSE value is [0] designates the chorus pattern). Following these initialization processing, the program proceeds to step Sa2.

In step Sa2, a judgement is made for each of the switches of panel switch 10 (See FIG. 3) as to whether or not the switch is ON. When an ON event is detected here, the result of this judgement is [YES], the program proceeds to the next step, step Sa3, and processing corresponding to each of the types of the switches which are ON is executed. In contrast, when no ON event is detected, the result of the judgement is [NO], and the program proceeds directly to step Sa4.

In step Sa4, other processing such as, for example, the generation of musical sounds corresponding to key processing or pushed keys, is performed. The program returns to step Sa2 following the completion of these processes and, until the electric power source is cut off, steps Sa2 through Sa4 are executed repeatedly. In this manner, the switch processing are executed in response to the settings in panel switch 10.

B-2: Switch Processing

Next, a detailed explanation of the switch processing will be made. Switch processing is processing to change or set the contents of each register and flag in response to the manipulation of each switch in panel switch 10.

B-2-1: Processing of Start/Restart Switch $SW_1$

Figure 5:
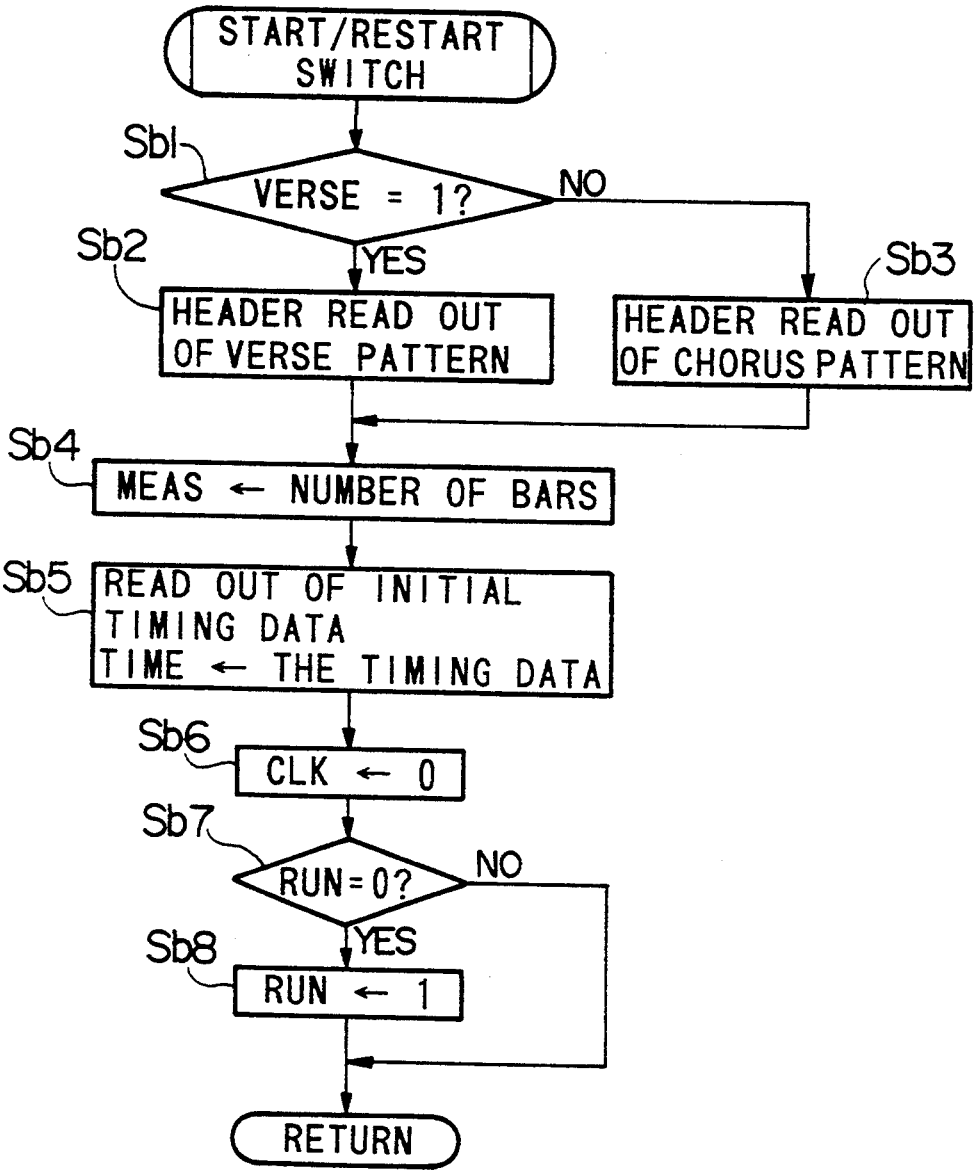
FIG. 5 is a flow chart showing the start/restart switch $SW_1$ processing in the automatic accompaniment device of the present invention.

When start/restart switch $SW_1$ is pushed, the subroutine shown in FIG. 5 is executed in step Sa3 of the main routine (See FIG. 4). In this routine, data corresponding to a verse pattern or chorus pattern is set in each register in order to start a normal pattern rhythm performance or to restart a normal pattern rhythm performance from the beginning by pushing the above switch..

Next, a detailed explanation of this processing will be made.

First, in step Sb1, a judgement is made as to whether or not the value of the flag VERSE is [1]. When the flag value is [1], the result of the judgement is [YES], the program proceeds to step Sb2 and the header (block A in FIG. 2) of the verse pattern is read out from ROM 5. When the flag value is not [1], then the result of the judgement is [NO], the program proceeds to step Sb3 is proceeded to and the header corresponding to the chorus pattern is read out.

Next, the data for the number of bars in the header read out in either step Sb2 or step Sb3, is stored in register MEAS (step Sb4), the initial timing data (block B1 in FIG. 2) of the applicable normal pattern is read out and stored in register TIME (step Sb5), and the value of the register CLK is reset to [0] (step Sb6). The register CLK is the register which designates the timing of the bars at the current point in time in a rhythm performance and is incriminated in the interrupt processing below. Further, register MEAS is the register for storing the data showing the progressing bar position in the rhythm pattern.

Continuing, in step Sb7, a judgement is made as to whether or not the value of the flag RUN is [0]. The flag RUN designates whether or not a rhythm performance is to be turned ON. When the flag RUN value is [1], the rhythm performance is turned ON. When the flag RUN value is [0], the value of the flag RUN is newly set to [1] (step Sb8), and this routine ends. In contrast, when the value of the flag RUN is not [0], this routine is directly ended, and processing returns to the main routine (See FIG. 4).

In the above described manner, the contents of the registers and flags necessary to a rhythm performance can be set, and the generation of music according to the timer interrupt processing, explained below, can be carried out.

B-2-2: Processing of Stop Switch $SW_2$

Figure 6:
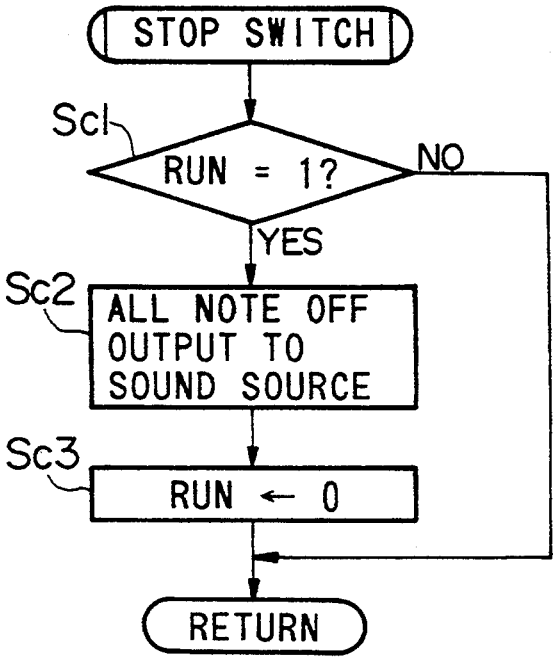
FIG. 6 is a flow chart showing the stop switch $SW_2$ processing in the automatic accompaniment device of the present invention.

When the stop switch $SW_2$ is pushed, the sub-routine shown in FIG. 6 is executed in step Sa3 of the above main routine (See FIG. 4).

First, in step Sc1, a judgement is made as to whether or not the value of the flag RUN is [1]. If the flag value is not [1], the result of the judgement is [NO], and the subroutine ends without any processing being performed. This is the reason why the operation of the stop switch $SW_2$ is not effective when the rhythm performance has an OFF status. In contrast, when the value of the flag RUN is [1], the result of the judgement is [YES], and the processing proceeds to the next step, step Sc2. In step Sc2, a NOTE OFF signal is supplied to the sound source circuit 7 and the generation of the rhythm sounds is interrupted. Continuing, in step Sc3, the flag RUN is reset to [0]. Following the end of this processing, this sub-routine ends and the processing returns to the main routine (See FIG. 4).

B-2-3: Processing of Verse Switch $SW_3$

Figure 7:
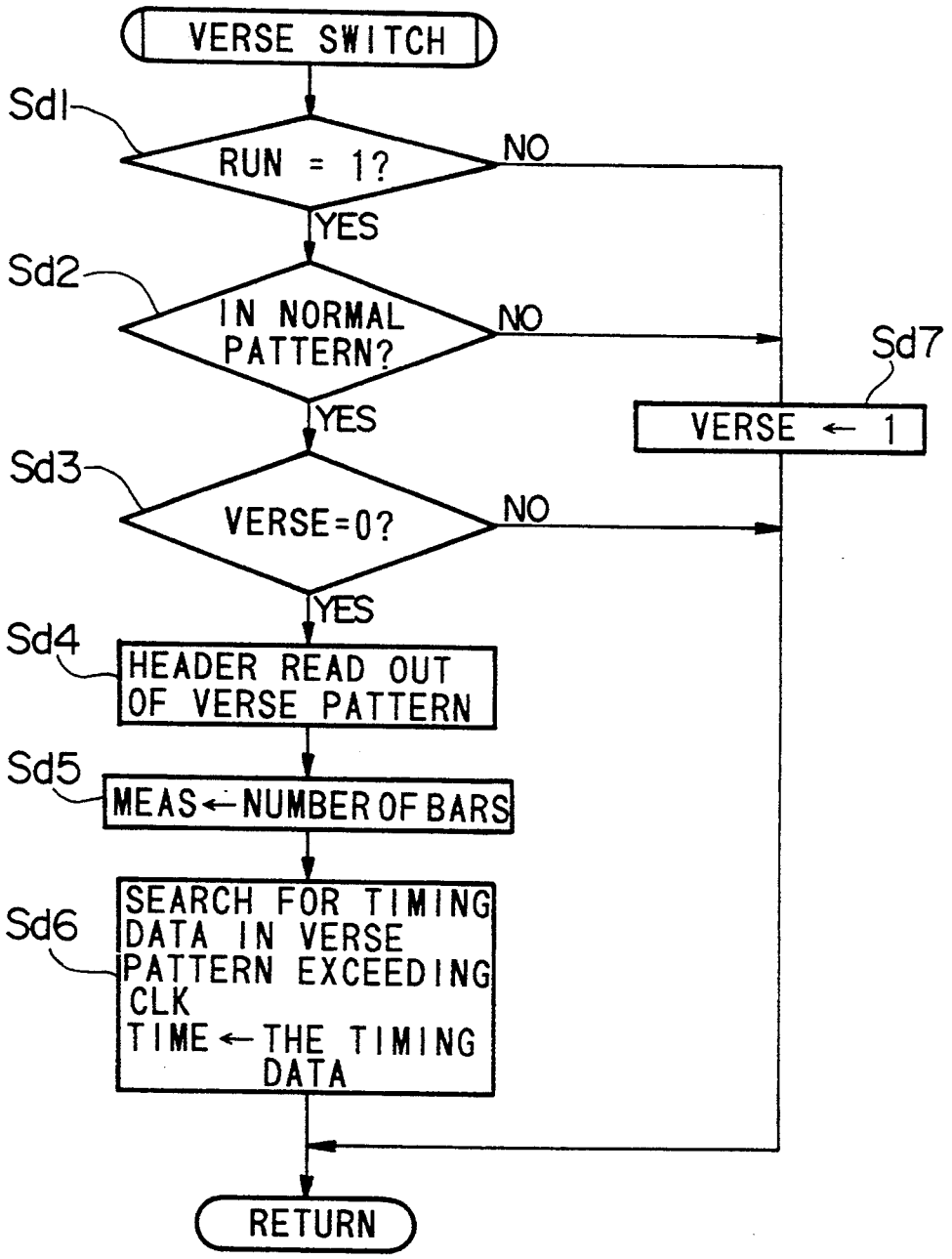
FIG. 7 is a flow chart showing the verse switch $SW_3$ processing in the automatic accompaniment device of the present invention.

When the verse switch $SW_3$ is pushed, the sub-routine shown in FIG. 7 is executed in step Sa3 of the main routine (See FIG. 4).

In this routine, a judgement is made as to whether or not the rhythm performance is ON and a further judgement is made as to whether or not the current performance is a normal pattern. When the performance is not a normal pattern, verse reservation is made. When the performance is a normal pattern, a judgement is made as to whether or not it is a verse pattern. If the performance is not a verse pattern, data for shifting to a verse pattern is set in each register. In contrast, if the pattern is a verse pattern, then the program returns to the main routine.

Next, a detailed explanation of this routine will be made.

First, in step Sd1, a judgement on whether or not the value of the flag RUN is [1] is made. If the flag value is not [1], then the result of the judgement is [NO], and the processing proceeds to step Sd7, explained below. In contrast, when the value of the flag RUN is [1], the result of the judgement is [YES], and the processing proceeds to the next step, step Sd2.

In step Sd2, a judgement is made as to whether or not the rhythm pattern at the current point in time is a normal pattern. If the rhythm pattern is not a normal pattern, ie., the current rhythm pattern is an introduction pattern or a fill-in pattern, then the result of the judgement is [NO] and the processing proceeds to the step Sd7, explained below. In contrast, if the rhythm pattern is a normal pattern then the result of the judgement is [YES] and the processing proceeds to the next step Sd3.

In step Sd3, a judgement is made as to whether or not the value of the flag VERSE is [0]. If the value of the flag VERSE is not [0] at this time, then this designates that the current rhythm pattern is a verse pattern of the normal patterns. Because there is no necessity to carry out any processing, this routine ends. In contrast, if the value of the flag VERSE is [0], then this designates that the current rhythm pattern is a chores pattern of the normal patterns. Because it is necessary to shift directly to the verse pattern, the proceeding steps Sd4 through Sd6 are executed.

In other words, the header (block A in FIG. 2) corresponding to the verse pattern is read out from ROM 5 (step Sd4). The bar number data of this header is stored in the register MEAS (step Sd5). Further, the timing data which exceeds the value of the register CLK and which is closest to the register CLK from the verse pattern value is searched for and is stored in register TIME (step Sd6). As a result, the event data corresponding to the timing in the current bar in the verse pattern are designated. Following the end of this step, this routine ends.

In contrast, when the result of the judgement in either of steps Sd1 or Sd2 is [NO], the processing proceeds to step Sd7 and the value of the flag VERSE is set to [1] (verse reservation).

As a result, the program may be set so that, when verse switch $SW_3$ is pushed during an interruption of a rhythm performance, a verse pattern rhythm performance is initiated by means of pushing the start/restart switch $SW_1$. Alternatively, the program may be set so that, when the verse switch $SW_3$ is pushed during an introduction or fill-in pattern, the normal pattern which is to be shifted to at the end of the introduction or fill-in pattern becomes the verse pattern. Following the end of this step, this routine ends and the processing returns to the main routine (See FIG. 4).

B-2-4: Processing of Chorus Switch $SW_4$

Figure 8:
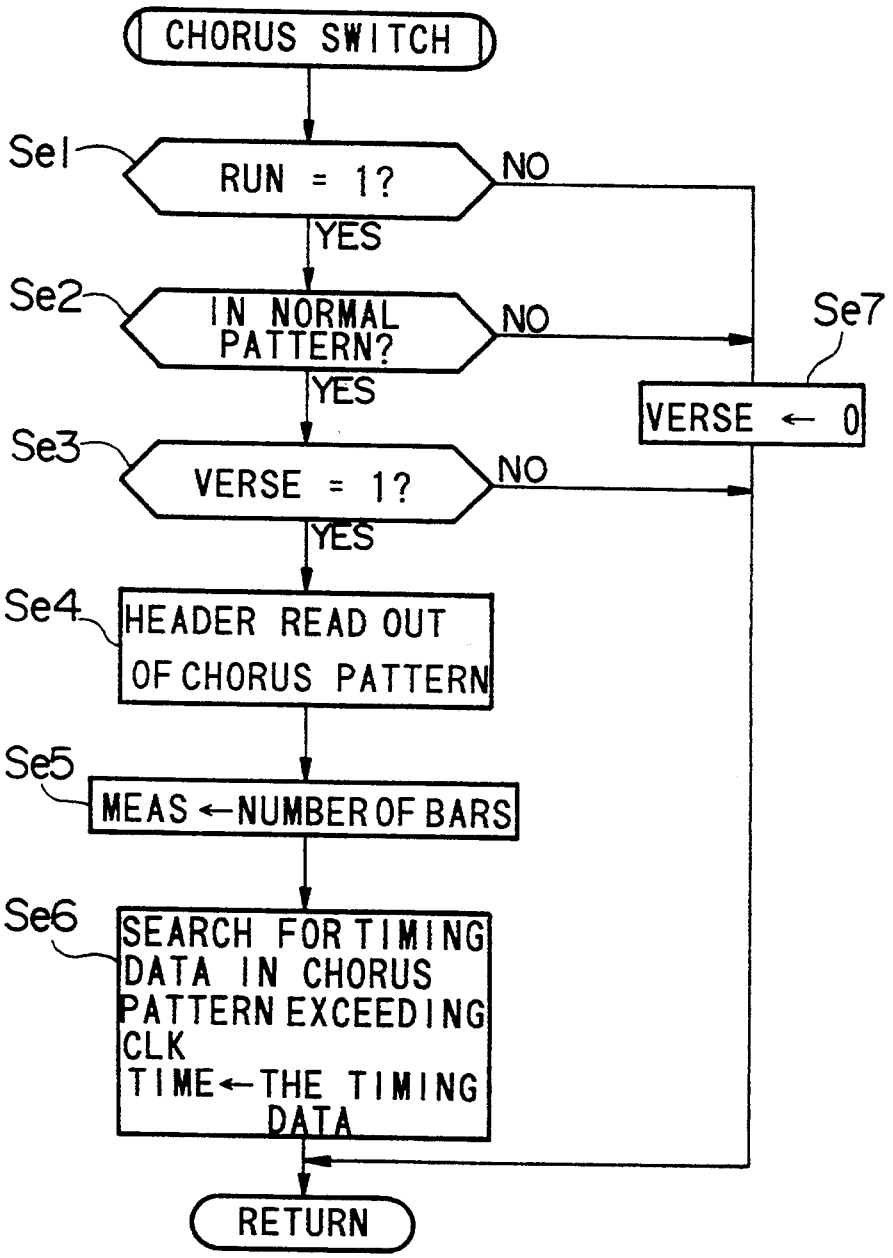
FIG. 8 is a flow chart showing the chorus switch $SW_4$ processing in the automatic accompaniment device of the present invention.

When the chorus switch $SW_4$ is pushed, the sub-routine shown in FIG. 8 is executed in step Sa3 of the main routine (See FIG. 4).

In this routine, a judgement is made as to whether or not the rhythm performance is ON (step Se1), and further, a judgement is made as to whether or not the performance is a normal pattern (step Se2). If the performance is not a normal pattern, then a chorus reservation is made (step Se7). When the performance is a normal pattern, then a further judgement is made as to whether or not the pattern is a chorus pattern (step Se3). When the pattern is not a chorus pattern, then the data for shifting directly to the chorus pattern is set in each of the registers. In contrast (steps Se4 through Se6), if this normal is a chorus pattern, then the program returns to the main routine.

Because this routine is represented in FIG. 7, a detailed explanation thereof is omitted.

B-2-5: Processing of Introduction 1/Fill-in ↓ Switch $SW_a$

Figure 9:
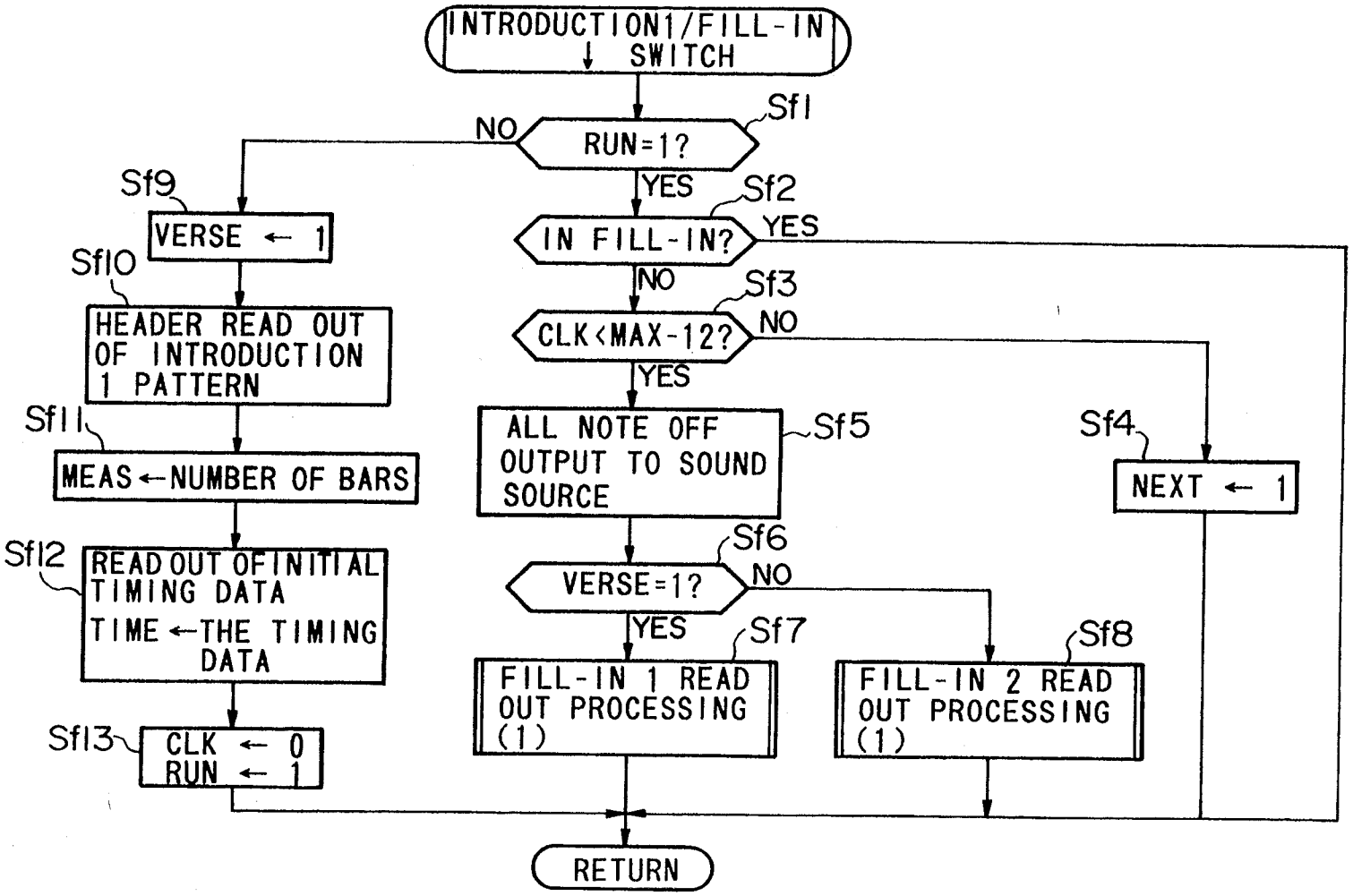
FIG. 9 is a flow chart showing the introduction 1/fill-in ↓ switch $SW_a$ processing in the automatic accompaniment device of the present invention.

When the introduction 1/fill-in ↓ switch $SW_a$ is pushed, the sub-routine shown in FIG. 9 is executed in step Sa3 of the main routine (See FIG. 4).

In this routine, a judgement is made to whether or not a rhythm performance in ON. When the rhythm performance is OFF, the data for initiating an introduction according to the introduction 1 pattern is set in each register. In contrast, when the rhythm performance is ON, a further judgement is made as to whether or not the rhythm performance at the current point in time is a half a beat or more before the end of the bar. If the performance has not yet reached a point a half beat before the end of the bar, sounding is halted, and the data for the fill-in to be inserted is set in each register. In contrast, if the performance has reached a point a half beat before the end of the bar, then the setting of the data for initiating, from the beginning, the fill-in pattern for the next bar is carried out.

First, a judgement as to whether or not the value of the flag RUN is [1] is made in step Sf1. If the flag value is not [1], then the result of the judgement is [NO], and the program proceeds to steps Sf9 through Sf13, explained below, and the data for initiating an introduction according to the introduction 1 pattern is set in each register. In contrast, when the value of the flag RUN is [1], the program proceeds to the following step Sf2.

In step Sf2, a judgement is made as to whether or not the current rhythm performance is in fill-in. If the performance is in fill-in, then the result of the judgement is [YES], and this routine ends. This is the reason why depressing the introduction 1/fill-in ↓ switch $SW_a$ during a fill-in is not effective. In contrast, when the current performance is not in fill-in, then the result of the judgement is [NO] and the program proceeds to the next step, step Sf3.

Next, in step Sf3, a judgement is made as to whether or not the register CLK value is smaller than the register MAX value less 12. The register MAX designates the maximum clock number of the bars. Further, in this embodiment, the length of a quarter note (one beat) corresponds to 24 clock lengths. In other words, in step Sf3, a judgement is made as to whether or not the timing in the bar at the current point in time in a rhythm performance has not yet reached a point a half note before the end of the bar.

When the result of this judgement is [NO], i.e., the rhythm performance has reached a point a half beat before the end of the bar, the processing proceeds to step Sf4, the value [1] is written in the next bar register NEXT, and this routine ends. The next bar register NEXT designates the rhythm pattern of the next bar to be performed. A normal pattern is designated by the value [0], a fill-in 1 pattern or fill-in 2 pattern is designated by the value [1], and a fill-in 3 pattern or fill-in 4 pattern is designated by the value [2].

In contrast, when the result of the judgement is [YES] in step Sf3, i.e., when the performance has not yet reached a point a half a beat before the end of the bar, then the processing proceeds to step Sf5, and a NOTE OFF signal is supplied to the sound source circuit 7 in FIG. 1 via the bus. As a result, the rhythm sounding is halted.

Next, in step Sf6, a judgement is made as to whether or not the value of the flag VERSE is [1], When the result of this judgement is [YES], the following fill-in 1 read out processing (1) (step Sf7) is carried out. In contrast, when the result of the judgement is [NO], the following fill-in 2 read out processing (1) (step Sf8) is carried out. When these read out processing (1) are completed, this routine ends.

However, when the result of the judgement in step Sf1 is [NO], the value of the flag VERSE is set to [1] (step Sf9), the header (block A in FIG. 2) of the introduction 1 pattern is read out from ROM 5 (step Sf10), and the data for the number of bars of this header is stored in register MEAS (step Sf11 ). The initial timing data (block B1 in FIG. 2) of this introduction 1 pattern is written in register TIME (step Sf12), and further, the values of register CLK and flag RUN are set to [0] and [1] respectively (step Sf13). As a result of the processing in these steps Sf9 through Sf13, data for introduction start according to introduction 1 pattern is set in each register.

Following the completion of the aforementioned processing, this sub-routine ends and the processing returns to the main routine (See FIG. 4).

B-2-6: Processing of Introduction 2/Fill-in →Switch $SW_b$

Figure 10:
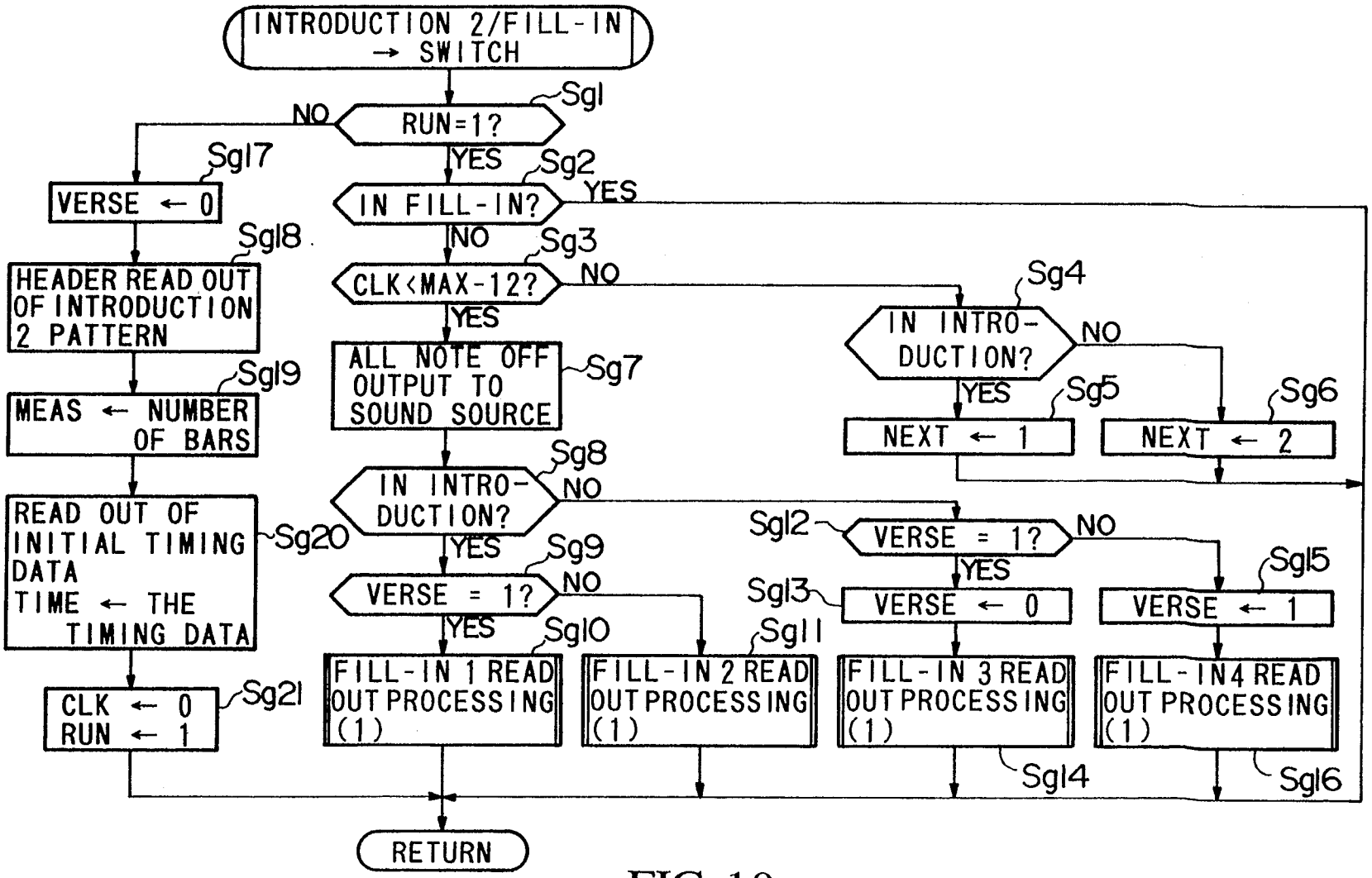
FIG. 10 is a flow chart showing the introduction 2/fill-in →switch $SW_b$ processing in the automatic accompaniment device of the present invention.

When the introduction 2/fill-in →switch $SW_b$ is pushed, the sub-routine shown in FIG. 10 is executed in step Sa3 of the main routine (See FIG. 4).

In this routine, a judgement is made as to whether or not the rhythm performance is ON. When the rhythm performance is OFF, the data for initiating an introduction according to the introduction 2 pattern is set in each register. In contrast, when the rhythm performance is ON, a further judgement is made as to whether or not the rhythm performance at the current point in time is a half a beat or more before the end of the bar. If the performance has not yet reached a point a half beat before the end of the bar, sounding is halted, and the data for the applicable fill-in to be inserted is set in each register. In contrast, if the performance has reached a point a half beat before the end of the bar, then the setting of the data for initiating, from the beginning, the applicable fill-in pattern in the next bar is carried out.

First, in step Sg1, a judgement is made as to whether or not the value of the flag RUN is [1]. If the flag value is not [1, then the result of the judgement is [NO], the program proceeds to the steps Sg17 through Sg21 below, and the data for initiating an introduction according to the introduction 2 pattern is set in each register.

In contrast, when the value of the flag RUN is [1], the program proceeds to the following step Sg2.

In step Sg2, a judgement is made as to whether or not the current rhythm performance is in fill-in. If the performance is in fill-in, then the result of the judgement is [YES], and this routine ends. This is the reason why pushing the introduction 2/fill-in →switch $SW_b$ during a fill-in is not effective. In contrast, when the current performance is not in fill-in, then the result of the judgement is [NO] and the processing proceeds to the next step, step Sg3.

Next, in step Sg3, a judgement is made as to whether or not the register CLK value is smaller than the register MAX value less 12. In other words, a judgement in made as to whether or not the timing in the bar at the current point in time in the rhythm performance has not yet reached a point a half beat before the end of the bar.

When the result of this judgement is [NO], i.e., the rhythm performance has not yet reached a point a half beat before the end of the bar, the program proceeds to step Sg4, and a judgement is made as to whether or not the rhythm performance at the current point is in introduction. If the performance is in introduction, then the result of the judgement is [YES] and the value [1] is written in the next bar register NEXT (step Sg5). In contrast, if the performance is not in introduction, then the result of the judgement is [NO] and the value [2] is written in the next bar register NEXT (step Sg6). Following completion of the processing of either of steps Sg5 and Sg6, this routines ends.

In contrast, when the result of the judgement in step Sg3 is [YES], then a NOTE OFF signal is supplied to the sound source circuit 7 in FIG. 1 via the verse (step Sg7). As a result, sounding is halted.

Next, in step Sg8, a judgement is made as to whether or not the rhythm performance at the current point in time is in introduction.

If the performance is in introduction, then the result of the judgement is [YES], processing proceeds to step Sg9 and a further judgement is made as to whether or not the value of the flag VERSE is [1]. When the flag VERSE value is [1], the following fill-in 1 read out processing (1) (step Sg10) is carried out. In contrast, when the value of the flag VERSE is not [1], then the following fill-in 2read out processing (1) (step Sg11 ) is carried out. When these read out processing (1) are completed, this routine ends.

In contrast, in step Sg8, if the current performance is not in introduction, then the result of this judgement is [NO], the processing proceeds to step Sg12, and a further judgement is made as to whether or not the flag VERSE value is [1].

When the flag VERSE value is [1], the value of the flag VERSE is inverted to [0] (step Sg13) and the following fill-in 3 read out processing (1) (step Sg14) is carried out. In contrast, when the flag VERSE value is not [1], then the value of the flag VERSE is inverted over to [1] (step Sg15) and the following fill-in 4 read out processing (1).(step Sg16) is carried out. When these read out processing (1) are completed, this routine ends.

However, when the result of the judgement in step Sg1 is [NO], the flag VERSE value is set to [0] (step Sg17), the header (block A in FIG. 2) of the introduction 2 pattern is read out from ROM 5 (step Sg18), and the data for the number of bars of this header is stored in register MEAS (step Sg19). The initial timing data (block B1 in FIG. 2) of this introduction 2 pattern is written in register TIME (step Sg20), and further, the values of register CLK and flag RUN are set to [0] and [1] respectively (step Sg21 ). As a result of the processing in these steps Sg17 through Sg21, data for an introduction start according to the introduction 2 pattern is set in each register.

Following the completion of the aforementioned processing, this sub-routine ends and the processing returns to the main routine (See FIG. 4).

B-3: Timer Interrupt Processing

Figure 11:
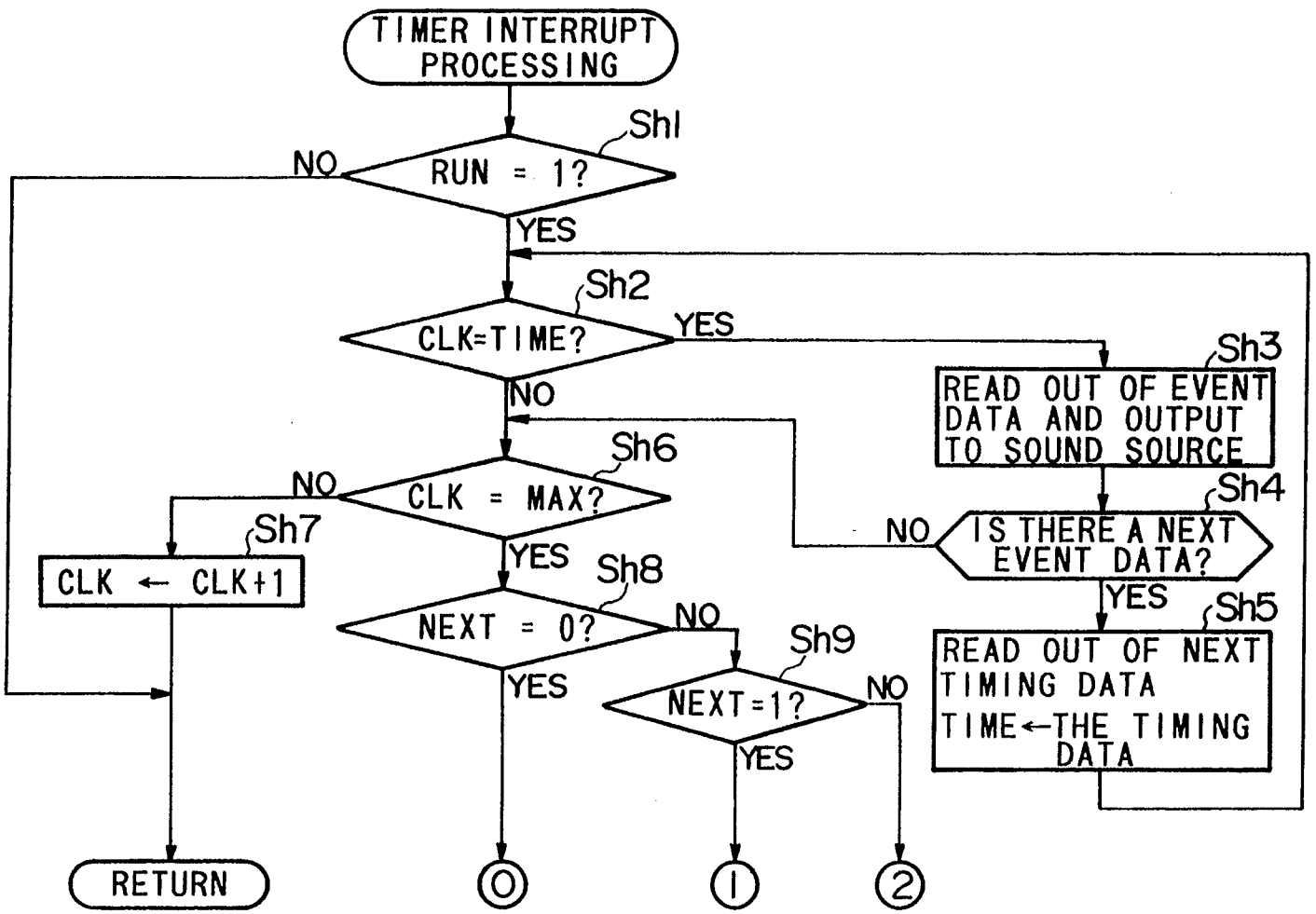
FIGS. 11 through 13 are flow charts showing the timing interrupter processing in the automatic accompaniment device of the present invention.

Next an explanation of timer interrupt processing will be made with reference being made to FIGS. 11 through 13.

This processing is executed 24 times for each quarter note according to the interrupt signal INT of timer 4 (in Figure). This execution period is variably controlled in accordance with tempo of the tune.

In this interrupt processing, the sounding processing when the timing in the bars during the performance and the value of the timing data stored in the register TIME are equivalent, and the data setting of the rhythm pattern to be performed in the next bar when the timing in the bar at time of performance has reached the last bar of the rhythm pattern is carried out.

Next, a detailed explanation of this interrupt processing will be made.

First, when this routine is activated, a judgement is made in step Sh1 as to whether or not the value of the flag RUN is [1]. When the result of this judgement is [NO], this routine ends directly. Since this timer interrupt processing is the processing for carrying out timing control of sounding in a rhythm performance, the timer interrupt processing is not necessary if a performance is not designated. In contrast, if the result of this judgement is [YES], the processing proceeds to step Sh2 and a further judgement is made as to whether or not the register CLK value and the register TIME value are identical.

If the values in register CLK and register TIME are not identical, the processing proceeds to step Sh6 below. In contrast, if these values are identical, because the processing is the sounding timing for the corresponding rhythm dam, the processing proceeds to step Sh3, and the note number and velocity are supplied to the sound source circuit 7 in FIG. 1 as note event data. As a result, rhythm sound is automatically sounded. Further, in step Sh4, a judgement is made as to whether the next timing data is present or not in the rhythm pattern. If present, the next timing data is read out, stored in register TIME (step Sh5), and the processing returns to the above step Sh2. In contrast, if there is no next timing data, then the processing proceeds to step Sh6.

In step Sh6, a judgement is made as to whether or not the value of the register CLK is the maximum value, i.e., as to whether or not the timing in the bar at the current point in time is the final timing of the bar. When the result of this judgement is [NO], the register CLK value to be shifted to the timing in the next bar is incriminated by [1] (step Sh7) and this routine ends.

In contrast, when the timing in the bar at this point in time is the last timing of the bar, a judgement is made on the register NEXT value (step Sh8 and Sh9). In other words, a judgement is made on the type of rhythm pattern to be performed in the next bar. If, according to the judgements made in these steps, the value of the register NEXT is [0], i.e., the rhythm pattern to be performed in the next bar is a normal pattern, the processing in steps Sh10 through Sh16 (See FIG. 12) are carried out. Further, if the value of the register NEXT is [1], i.e., if the rhythm pattern to be performed in the next bar is a fill-in 1 pattern or a fill-in 2 pattern, then the processing in steps Sh18 through Sh21 (See FIG. 13) are carried out. Alternatively, if the value of the register NEXT is [2], i.e., if the rhythm pattern to be performed in the next bar, is a fill-in 3 pattern or a fill-in 4 pattern, then the processing of steps Sh22 through Sh26 and Step Sh21 are carried out. Following this processing, the resetting of register CLK is carried out in step Sh17, and this timer interrupt processing ends.

Figure 12:
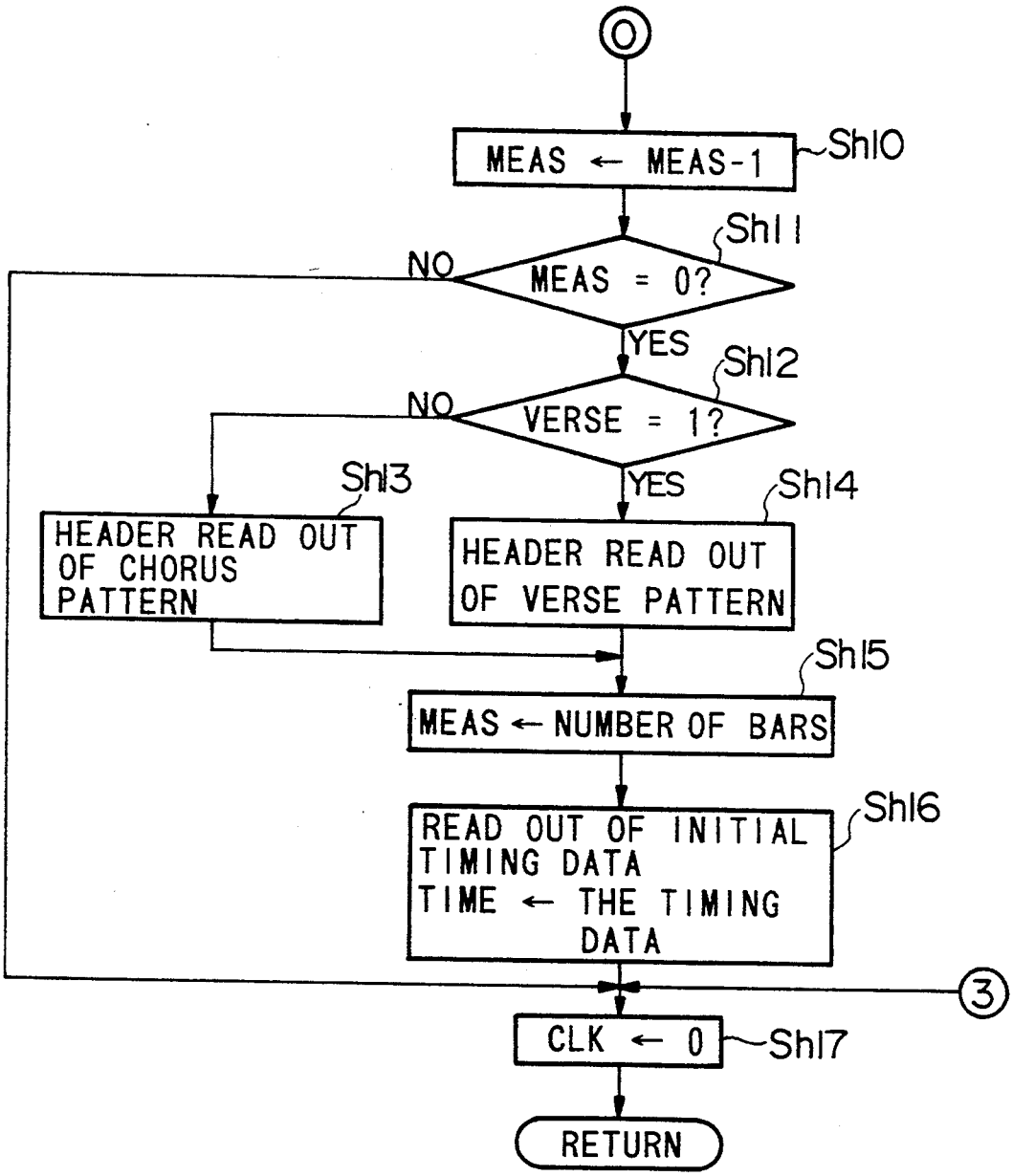

When a judgement is reached in step Sh8 that the value in register NEXT is [0], this processing proceeds to step Sh10 shown in FIG. 12.

The value in register MEAS is decreased by 1 in step Sh10, and this value is newly stored as the register MEAS value. Continuing, in step Sh11, a judgement is made as to whether or not the value in register MEAS is [0], i.e. as to whether or not the rhythm pattern being performed at the current point in time has completed the final bar. If the result of this judgement is [NO], then the processing proceeds to step Sh17 below. In contrast, if the result of the judgement is [YES], then the processing of the following steps Sh12 through Sh16, wherein the program shifts or returns to the beginning of the selected normal pattern, are carried out.

In other words, a judgement is made as to whether the value of the flag VERSE is [1] (step Sh12). If the flag value is not [1], the header (block A in FIG. 2) of the chorus pattern is read out from ROM 5 (step Sh13). If the flag value is [1], the header of the verse pattern is read out from ROM 5 (step Sh14). In either step, the bar number data in the read out headers is stored in register MEAS (step Sh15). The initial timing data (block B in FIG. 2) of this normal pattern is read out and stored in register TIME (step Sh16).

Figure 13:
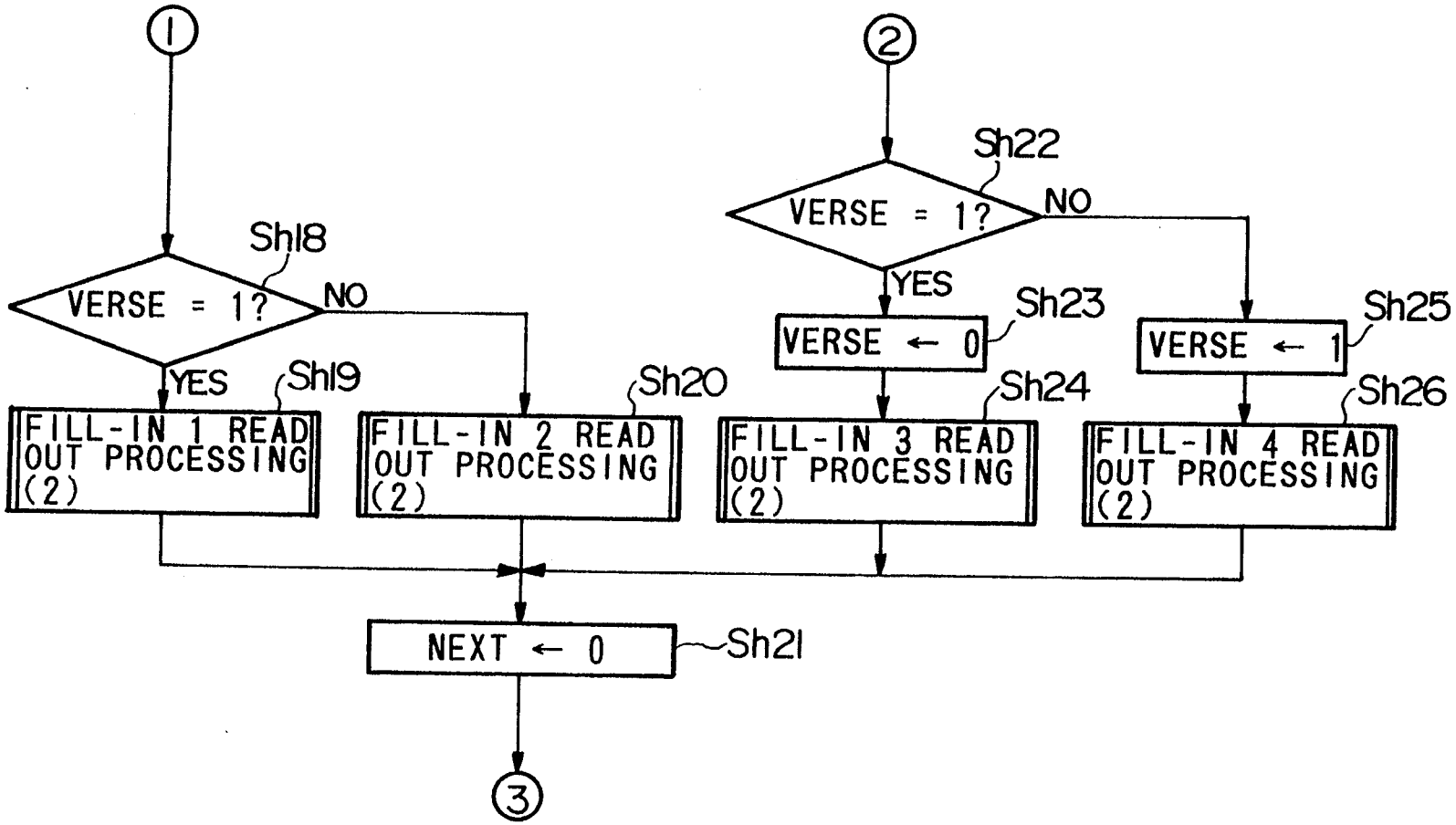

In contrast, in step Sh9 (see FIG. 11 ), when a judgement has been made that the register NEXT value is [1], this processing proceeds to step Sh18 in FIG. 13.

In step Sh18 a judgement is made as to whether or not the value of the flag VERSE is [1]. When the flag value is [1], the following fill-in 1 read out processing (2) (step Sh19) is carried out. In contrast, when the flag value is not [1], the following fill-in 2 read out processing (2) (step Sh20) is carried out. When these read out processing (2) are completed, the processing proceeds to step Sh21 and the value of the register NEXT is set to [0].

In contrast, in step Sh9 (See FIG. 11) when a judgement has been made that the value of the register NEXT is [2], this processing proceeds to step Sh22 in FIG. 13.

In step Sh22 a judgement is made as to whether or not the value of the flag VERSE is [1]. When the flag value is [1], the value of the flag VERSE is inverted and becomes [0] (step Sh23), and the following fill-in 3 read out processing (2) (step Sh24) is carried out. In contrast, when the flag value is not [1], the value of the flag VERSE is inverted over and becomes [1] (step Sh25) and the following fill-in 4 read out processing (1) (step Sh26) is carried out. When-these read out processing (2) are completed, the processing proceeds to step Sh21 and the value of the register NEXT is set to [0].

When the processing of step Sh21 is completed, the program proceeds to step Sh17 in FIG. 12, the value of register CLK is reset and this timing interrupt processing ends.

C: Common Routine

C-1: Fill-In n Read Out Processing (1)

Figure 14:
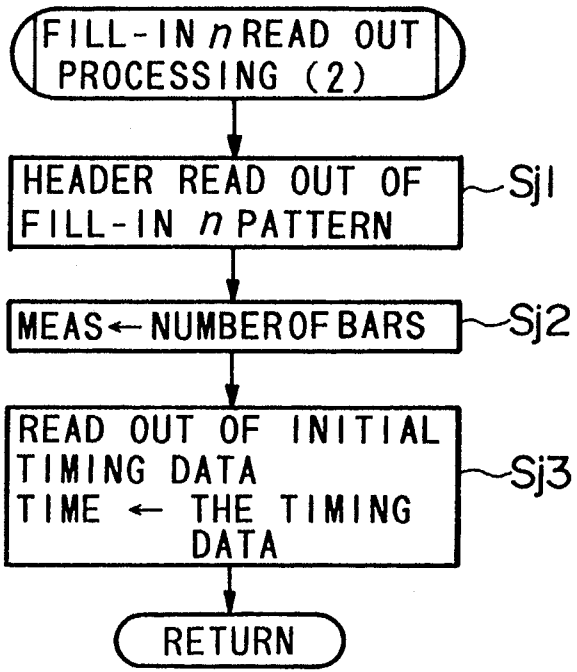
FIG. 14 (*a*) is a flow chart showing the fill-in n readout processing (1) in the automatic accompaniment device of the present invention.
Figure 14:
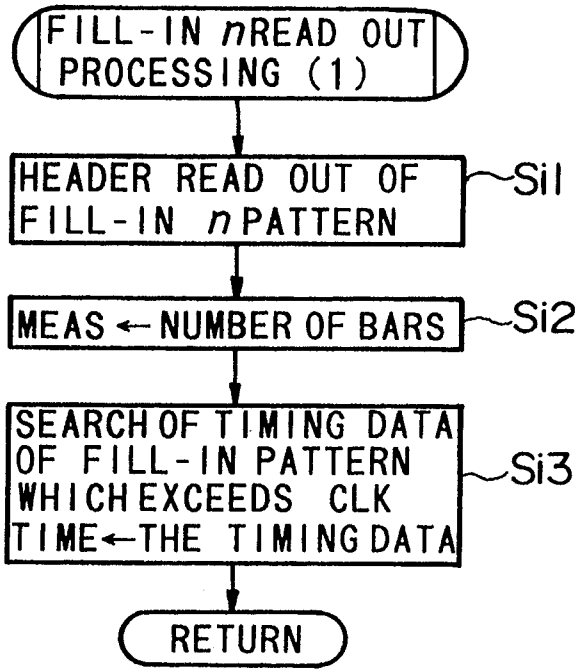

The above processing proceeds to one of either steps Sf7 or Sf8 in FIG. 9 or steps Sg10, Sg11, Sg14, or Sg16 shown in FIG. 10, and the fill-in n read out processing (1) shown in FIG. 14 (*a*) is executed. Data is set in each register for the fill-in pattern which is to be inserted and which corresponds to the rhythm performance at the current point in time. Here, n has the value of either 1, 2, 3, or 4, and is equal to the corresponding step.

First, when this read out processing (1) is activated, the header (block A in Figure 2) corresponding to the fill-in n pattern is read out from ROM 5 in step Si1. Next, in step Si2, the bar number data of the read out header is stored in register MEAS. Further, in step Si3, the timing data which exceeds the value of register CLK at the current point in time is searched from the fill-in n pattern and is stored in register TIME, ending this read out processing (1).

C-2: Fill-In n Read Out Processing (2)

The above processing proceeds to one of either steps Sh19, Sh20, Sh24, or Sh26, shown in FIG. 13, and the fill-in n read out processing (2) shown in FIG. 14 (*b*) is executed. Data is set in each register for the fill-in pattern which is to be started from the beginning thereof. Here, n has the value of either 1, 2, 3, or 4, and is equal to the corresponding step.

First, when this read out processing (2) is activated, the header (block A in FIG. 2) corresponding to the fill-in n pattern is read out from ROM 5 in step Sj1. Next, in step Sj2, the bar number data of the read out header is stored in register MEAS. Further, in step Sj3, the initial timing data (block B1 in FIG. 2) is read out from the fill-in n pattern and is stored in register TIME, ending this read out processing (2).

Further, timing data set by either of these read out processing (1) or (2) is sounded according to timer interrupt processing when it is equal to the bar timing at the current point in time.

In the above described embodiment, a rhythm pattern was applied as the accompaniment pattern, however, it is of course possible to use other accompaniment patterns such as, for example, a base pattern or a chord pattern.

Further, the fill-in pattern inserted during the performance of a normal pattern, and the fill-in pattern inserted during the performance of an introduction pattern need not be identical patterns.

Additionally, when shifting from an introduction pattern to a fill-in pattern, the fill-in pattern may be varied in correspondence with the bar number (the contents of register MEAS). As a result, it becomes possible to insert the most appropriate fill-in pattern in response to the position in the introduction pattern, and a more natural sound is achieved when shifting to the fill-in pattern.

Moreover, a pattern optionally formed by the user may be applied as the accompaniment pattern (each of the introduction, fill-in, and normal patterns).

As many apparently widely-differing embodiments of this invention may be made without departing from the spirit and scope thereof, it is to be understood that the invention is not limited to the specific embodiments thereof except as defined in the appended claim.

What is claimed is:

1. An automatic accompaniment device comprising:

a storing means for storing each of a first accompaniment pattern consisting of a plurality of bars, a second accompaniment pattern consisting of an optional number of bars and a third accompaniment pattern consisting of fewer bars than said first accompaniment pattern;

a first designating means which designates the read out of said first accompaniment pattern read out from said storing means;

a second designating means which designates the read out of said third accompaniment pattern read out from said storing means; and a read out means which reads out said first accompaniment pattern in response to a read out designation from said first designating means, and the read out means thereafter repeatedly reading out said second accompaniment pattern, the read out means also reading out said third accompaniment pattern in place of said first accompaniment pattern after a musically natural optional point in the first accompaniment pattern when a read out designation is made by second designating means during the read out of said first accompaniment pattern, the read out third accompaniment pattern providing a musically natural transition between the first accompaniment pattern and the second accompaniment pattern such that the first accompaniment pattern is read out for a musically natural period of time that is less than the full plurality of bars in the first accompaniment pattern, and the read out means thereafter repeatedly reading out said second accompaniment pattern; and accompaniment generating means for generating accompaniment sound according to an accompaniment pattern read out by said read out means.

2. An automatic accompaniment device in accordance with claim 1, wherein said first accompaniment pattern is an introduction pattern performed at the beginning of a performance, said second accompaniment pattern is a normal pattern performed repeatedly, and said third accompaniment pattern is a fill-in pattern inserted during the performance of a normal pattern.

3. An automatic accompaniment device in accordance with claim 2, wherein said first designating means designates the beginning of an introduction performance, and said second designating means designates a fill-in performance.

4. An automatic accompaniment device in accordance with claim 1, wherein a plurality of patterns are set for said second accompaniment pattern and said third accompaniment pattern, and said third accompaniment pattern is selected in accordance with a second accompaniment pattern to be read out after said third accompaniment pattern.

5. An automatic accompaniment device in accordance with claim 4, wherein said second accompaniment pattern can be changed during a performance based on said third accompaniment pattern.

6. An automatic accompaniment device in accordance with claim 1, wherein a plurality of patterns are set for said first accompaniment pattern and said second accompaniment pattern, and said second accompaniment pattern is selected in accordance with a selected first accompaniment pattern.

7. An automatic accompaniment device in accordance with claim 6, wherein said selected second accompaniment pattern can be changed during a performance based on said first accompaniment pattern.

8. An automatic accompaniment device comprising:

a storing means for storing each of an introduction pattern and a normal pattern;

a designating means which designates switching from an introduction performance into a normal performance; and a read out means which reads out said introduction pattern, and which reads out from the beginning of said normal pattern in place of said introduction pattern after a musically natural optional point in the introduction pattern when a switching designation is made by said designating means; and accompaniment generating means for generating accompaniment sound according to a pattern read out by said read out means;

wherein a plurality of patterns are set for said introduction pattern and said normal pattern, and a normal pattern is selected in accordance with a selected introduction pattern.

9. An automatic accompaniment device in accordance with claim 8, wherein said selected normal pattern can be changed during an introduction performance based on an introduction pattern.

10. A method of performing an automatic accompaniment with an introduction pattern, the method comprising the steps of:

storing each of an introduction pattern, a fill-in pattern and a normal pattern;

designating a read out of said introduction pattern;

designating a read out of said fill-in pattern;

reading out said designated introduction pattern in response to a read out designation;

reading out said fill-in pattern in place of said designated introduction pattern after a musically natural optional point in the introduction pattern reading out said normal pattern after completion of said fill-in pattern; and generating accompaniment sound according to a read out pattern.

11. The method in accordance with claim 10, further including the steps of:

setting a plurality of patterns for said normal pattern and said fill-in pattern; and selecting a fill-in pattern in accordance with a normal pattern to be read out after said fill-in pattern.

12. The method in accordance with claim 11, further including the step of changing said normal pattern during a performance based on a fill-in pattern.

13. The method in accordance with claim 10, further including the steps of:

setting a plurality of patterns for said introduction pattern and said normal pattern; and selecting a normal pattern in accordance with a selected introduction pattern.

14. The method in accordance with claim 13, further including the step of changing said selected normal pattern during an introduction performance based on an introduction pattern.

* * * * *